United States Patent [19]

Gach

[11] 4,436,211

[45] Mar. 13, 1984

[54] SAFETY PACKAGE

[75] Inventor: Peter P. Gach, Evansville, Ind.

[73] Assignee: Sunbeam Plastics Corporation, Evansville, Ind.

[21] Appl. No.: 450,686

[22] Filed: Dec. 17, 1982

[51] Int. Cl.[3] ..... B65D 55/02

[52] U.S. Cl. ..... 215/216

[58] Field of Search ..... 215/216, 217, 218, 219, 215/221, 330

[56] References Cited

U.S. PATENT DOCUMENTS 3,884,379 5/1975 Landen ..... 215/216

4,383,618 5/1983 Dougherty ..... 215/216

*Primary Examiner*—George T. Hall

*Attorney, Agent, or Firm*—Fisher, Gerhardt, Crampton & Groh

[57] ABSTRACT

A safety package including a container with a unitary screw type cap in which the container has a locking lug engageable with one of a plurality of ratchet teeth located around the circumference of the cap. The ratchet teeth permit turning movement of the cap in a closing direction until the cap is squeezed and deformed at diametrically opposed points to move the engaged ratchet tooth out of engagement with the locking lug to permit turning movement of the cap to an opening position. A second locking lug is offset from a point diametrically spaced from the first locking lug so that one or the other of the lugs engages a ratchet tooth thereby doubling the effectiveness of the teeth.

9 Claims, 3 Drawing Figures

SAFETY PACKAGE

This invention relates to packaging utilizing containers with closures and more particularly to a safety or child resistant package including a closure and container combination.

Many substances stored in homes, such as detergents, cleaning compounds, insecticides and pharmaceuticals are potentially harmful to children. Ideally such substances should be packaged in containers easily openable by an intentional act of an adult but which are significantly difficult for a young child to open. A variety of such safety closures and containers have been provided in the past, among them screw type closures or caps on containers which have interlocking lugs on the cap and the container permitting ratcheting in a closing direction but which engage each other and prevent removal, unless some further operation is performed such as squeezing or moving a latch. Unfortunately, with such closures they must be designed so that the lug on the cap moves a reasonable distance beyond the lug on the container to accommodate manufacturing tolerances so that an appropriate seal can be accomplished between the closure and container. In such arrangements the child usually is free to rotate the closure in a removal direction to a point where the complementary locking lugs again engage and in doing so the primary seal between the closure and container is loosened and the package will leak. Also with such locking lug or locking tooth arrangements, attempts to minimize the leakage problem have resulted in packages with sets of diametrically opposed teeth on the container, on the closure or on both. This offers a partial solution but usually unduly complicate the opening by requiring a deflection of the container and thereby requiring that the container be made of a flexible material.

According to this invention, a unitary cap is provided for closing the opening of a container having a neck forming an opening. The cap is a unitary cap made of plastic material having a flexible outer skirt. Complementary cam means in the form of fast threads are formed on the neck of the container and on the cap to permit relative axial movement of the closure between a closed position and an open position upon relative rotation of the closure and the container in less than one full turn. The cap includes a flexible outer skirt concentric with the remainder of the cap and has a plurality of uniformly spaced ratchet teeth. A complementary lock element is formed on the container and is engageable with the teeth so that the cap can be turned towards a closing position during which time the teeth will ratchet over the lock element. However, upon opening movement the lock element engages with one of the teeth to prevent turning movement in an opening direction. A large number of teeth are provided on the cap so that the maximum amount of turning movement in an opening direction before unlocking is limited to the spacing between adjacent teeth. An additional lock element is formed on the container and is slightly offset from the exact diametrically spaced point of the first lock element so that when the first lock element is engaged with a tooth on the cap, the second lock element is disposed intermediate adjacent teeth in a disengaged condition. This further minimizes the amount of turning movement that is afforded in an opening direction from a locked position in which one or the other of the lock elements is engaged with one of the plurality of teeth on the closure.

A preferred embodiment of the invention is illustrated in the drawings in which.

Figure 1:
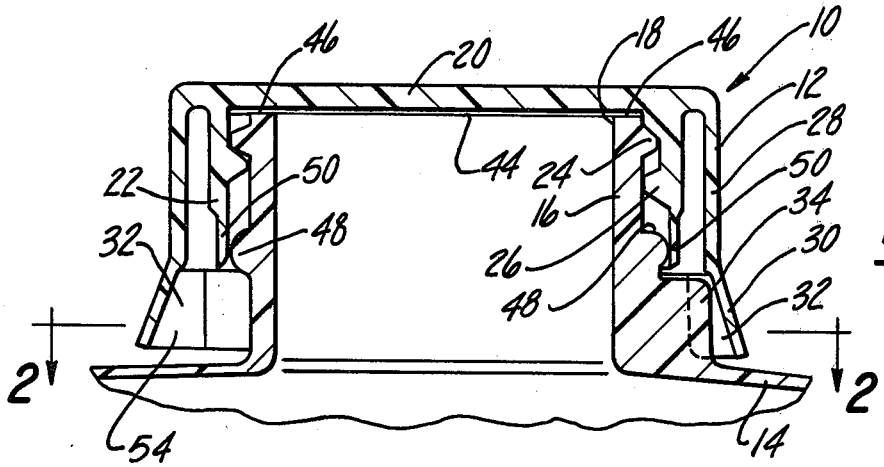
FIG. 1 is a cross-sectional view showing the closure and a portion of the container embodying the invention.

Referring to the drawings a package 10 embodying the invention is in the form of a closure 12 and a container 14. The container 14, a portion of which is shown, includes a cylindrical neck 16 forming an opening 18 which is closed and sealed by closure 12. The closure 12 includes a cylindrical cap having a disc shaped top 20 and a depending cylindrical wall 22 which in the closed condition of the package 10 is concentric with the neck 16.

The neck 16 of the container 14 and the internal surface of the cylindrical wall 22 of the closure 12 are formed with complementary cam means 24 and 26, respectively. The cam means 24, 26 also can be described as fast pitch threads in that the full axial range of movement of the closure 12 relative to the container 14 occurs in less than a full revolution of the closure 12 relative to the container 14. In the illustrated embodiment of the invention there are three sets of complementary threads or cam means 24 and 26 so that one-third of a full turn of the closure 12 relative to the container 14 is required for the full axial range of movement between a fully closed and a fully opened position.

The closure 12 also includes an outer skirt 28 which is concentric with the cylindrical wall 22. The outer skirt 28 depends from the outer circumference of the disc top 20 and its lower edge is provided with a flared skirt portion 30. The inner portion of the flared skirt 30 is provided with a plurality of ratchet teeth 32 which are uniformly spaced around the circumference of the flared skirt 30.

Figure 2:
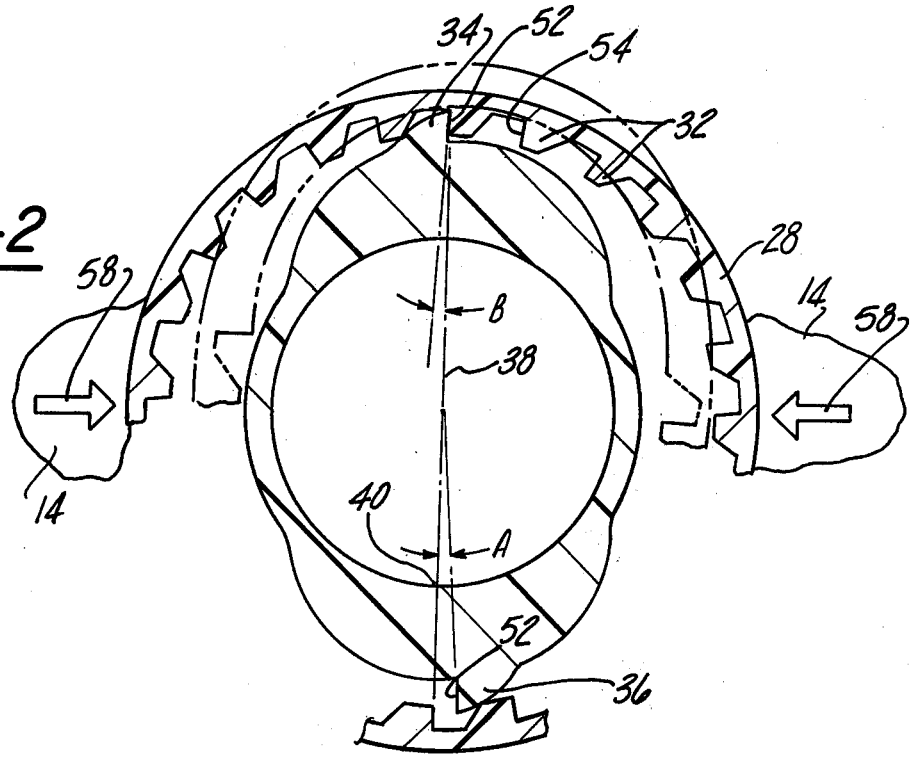
FIG. 2 is a cross-sectional view on line 2—2 in FIG. 1 showing the coaction between the closure and container.
Figure 3:
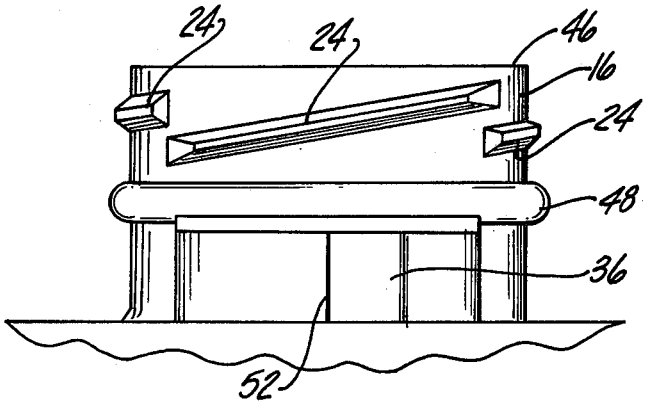
FIG. 3 is a side elevation of the neck of the container showing arrangement of the cams or threads.

The ratchet teeth 32 coact with a complementary lock element 34 which is formed on the outside of the neck 16 of the container 14 at the juncture of the neck 16 with the body of the container. At least one such lock element 34 is required but preferably a second lock element 36 identical to lock element 34 is employed. The second lock element 36 is offset to one side of a diametric plane indicated by a line 38 in FIG. 2 and passing through the neck 16 and the locking surface of the lock element 34, the second lock element 36 is offset to one side of a point 40 diametrically opposed to the lock surface of element 34 in an amount less than the spacing of ratchet teeth 32. For example, if there are twenty-four ratchet teeth uniformly spaced, the spacing is 15° and the second lock element 36 can be offset an amount indicated by dimension A, for example, approximately 5°. This insures that when the lock element 34 is engaged with one of the ratchet teeth 32 the other lock element 36 will be intermediate adjacent ratchet teeth 32 substantially diametrically opposite the lock element 34. Similarly with lock element 36 engaged, lock element 34 will be between adjacent teeth. This arrangement will increase the effectiveness of the number of ratchet teeth in that closure 12 can be turned in an opening direction from a locked position a distance of the spacing between adjacent teeth when only one lock element is used or when a pair of diametrically aligned lock elements are used. However, with the use of a second offset lock element 36, the distance that the closure can be moved in an opening direction is reduced to only a portion of the spacing between the adjacent teeth 32 thereby producing the effect of twice the number of teeth actually used.

The closure 12 also is provided with a liner or a seal 44 which in the closed position of the package 10 seals against the underside of the disc shaped top 20 and the top annular sealing surface 46 on the neck 16. In the closed position of the package 10, the liner 44 provides a fluid tight seal which prevents fluid leakage. To enhance sealing a secondary sealing arrangement is provided in the form of an annular sealing collar 48 on the exterior of the neck 16 which engages a lower annular portion of the cylindrical wall as indicated at 50.

During the manufacturing operation when the container 14 has been filled with its intended contents such as a liquid material, the closure 12 can be applied either manually or mechanically to turn the closure 12 to engage the complementary fast threads 24 and 26 on the closure 12 and container 14. During such turning movement the ratchet teeth 32 flex radially outwardly together with the flared skirt 30 as each of the successive teeth passes the lock elements 34 and 36. The fully closed sealed position is achieved in approximately one-third of a revolution and in the finally closed and sealed position at least one of the lock elements 34 or 36 is engaged with one of the ratchet teeth 32. The teeth 32 and the lock elements 34, 36 have complementary generally radially extending surfaces 52 and 54 which engage each other to prevent rotation of the closure 12 in an opening direction. To enchance the locking engagement of the surfaces 52 and 54 they do not extend strictly radially but each is back-cut so that the engaging surfaces are at an angle approximately 5° indicated by dimension B, for example, from the diametric plane of the closure 12 and container 14.

To open the package 10, it is necessary to deflect the outer skirt 28 of the closure 12 at diametrically spaced points disposed substantially midway between the lock elements 34 and 36. For this purpose indicia in the form of arrows 58 are formed on the container 14 substantially midway between the lock elements 34 and 36. By squeezing the outer skirt 28 at these points, the skirt is deflected radially inwardly and simultaneously the portions of the skirt 28 adjacent to the lock elements 34 and 36 are moved radially outwardly an equal amount so that the complementary engaging surfaces 52 and 54 are disengaged. Subsequent rotation of the closure 12 in an opening direction causes the cam means, or threads 24, 26 to move the closure 12 axially of the container 14 so that the closure 12 reaches a fully opened position in substantially one-third of a revolution. If, however, the necessary turning to produce opening is not accomplished, the closure 12 can be released permitting the skirt 28 to resume its normal circular position and the closure can again be squeezed at the indicia 58 to make whatever additional turning movement is required to disengage the closure 12 from the container 14.

After a portion of the contents of the container 14 have been utilized, the closure 12 can be replaced on the neck 16 by rotating the closure 12 approximately one-third of a turn which will bring the liner 44 into sealing engagement with the annular sealing surface 46 and also the annular sealing skirt 50 into engagement with the annular sealing collar 48. After each reclosing, opening movement is limited to the distance between adjacent teeth 32 or with a second lock element 36 to substantially less than the distance between adjacent teeth.

A package has been provided in which a closure and container have complementary fast threads so that less than a full turn of the closure is required to open the container. The closure is provided with a plurality of uniformly spaced ratchet teeth which engage one or the other of a pair of lock elements which are slightly offset from each other relative to a diametric plane so that only one or the other of the lock elements is fully engaged with the teeth. Opening movement is achieved by squeezing the closure at diametrically spaced points intermediate the lock elements on the container to deflect the teeth radially outwardly out of engagement with the lock elements so subsequent turning movement through less than a full turn results in axial movement from a closed to an open position of the container 14.

The embodiments of the invention in which an exclusive property or privilege is claimed are defined as follows:

1. A safety package comprising: a container having a cylindrical neck portion forming an opening, a cylindrical cap disposed on said neck for closing said opening, complementary cam means on said neck of said container and on said cap to permit relative axial movement between a first position closing said opening and a second position permitting removal of said cap upon relative rotation of said cap and container less than one turn, said cap including an outer skirt concentric with said cap, a plurality of ratchet teeth uniformly spaced on the circumference of said skirt, a lock element on said container engageable with said teeth to permit rotation of said cap in a closing direction toward said first position and being engageable with any one of said teeth to substantially prevent relative rotation of said container and cap toward said 2nd position for a distance more than the spacing between adjacent teeth, said skirt being deformable by simultaneous radial pressure at diametrically spaced points on said skirt spaced approximately 90° from said lock element to move said one of said teeth radially outward and disengage said lock element from said one of said teeth to permit relative rotation of said cap and closure in an opening direction.

2. The safety package of claim 1 including an additional lock element spaced less than the distance of the spacing between the adjacent teeth from a point diametrically opposed to the first named lock element whereby one of said lock elements is engageable with one of said teeth in the closed position of said package to resist opening movement of said closure relative to said container.

3. The safety package of claim 2 wherein the spacing of said lock element from said point is no greater than one-half the distance between adjacent teeth.

4. The safety package of claim 1 wherein said cam means include two sets of complementary engageable cam elements permitting opening in substantially one-half rotation of said cap relative to said container.

5. The safety package of claim 1 wherein said cam means include three sets of complementary cam elements permitting axial movement of said cap from said container substantially one-third of a turn of said cap from said closed position.

6. The safety package of claim 1 wherein said cylindrical cap has an open end defined by a circumferential lip, and an annular seal formed on said neck and engageable with said lip when said cap is in a closed position on said neck.

7. The safety package of claim 1 wherein said ratchet teeth and lock element have radially disposed complementary surfaces, said skirt being spaced from said cylindrical cap a distance sufficient to permit distortion of said skirt radially inwardly to move said surface on said one of said teeth radially outwardly for movement in a path radially outward of the surface on said lock element during opening rotation of said cap.

8. The safety package of claim 1 wherein indicia are disposed on said container substantially midway of said lock elements to indicate squeeze points on said cap.

9. The safety package of claim 6 wherein said annular seal is disposed axially between said cam elements and said lock elements.

* * * * *